US006119654A

United States Patent [19]

Heiselbetz et al.

[11] Patent Number: 6,119,654

[45] Date of Patent: Sep. 19, 2000

[54] METHOD FOR ADJUSTING THE OPERATING ENERGY INPUT OF A MOTOR

[75] Inventors: Christian Heiselbetz, Leinfelden-Echterdingen; Dieter Kalweit, Schorndorf; Thomas Klaiber, Weinstadt; Uwe Kleinecke, Winnenden; Kurt Maute, Sindelfingen, all of Germany

[73] Assignee: DaimlerChrysler AG, Stuttgart, Germany

[21] Appl. No.: 09/253,946

[22] Filed: Feb. 22, 1999

[30] Foreign Application Priority Data

Feb. 20, 1998 [DE] Germany ..... 198 07 126

[51] Int. Cl.[7] ..... F02D 43/00

[52] U.S. Cl. ..... 123/350; 123/339.11

[58] Field of Search ..... 123/350, 339.11; 701/110

[56] References Cited

U.S. PATENT DOCUMENTS

| | | | |
|---|---|---|---|
| 4,853,720 | 8/1989 | Onari et al. | 364/431.07 |
| 5,479,898 | 1/1996 | Cullen et al. | 123/350 |
| 5,575,257 | 11/1996 | Lange et al. | 123/339.11 |
| 5,692,471 | 12/1997 | Zhang | 123/350 |

FOREIGN PATENT DOCUMENTS

| | | |
|---|---|---|
| 44 07 475 A1 | of 1995 | Germany . |
| 19517675 | of 1996 | Germany . |
| 4343353 | of 1996 | Germany . |
| 463945 | of 1992 | Japan . |
| 7208309 | of 1995 | Japan . |
| 8218911 | of 1996 | Japan . |
| 8312406 | of 1996 | Japan . |

*Primary Examiner*—Henry C. Yuen
*Assistant Examiner*—Arnold Castro
*Attorney, Agent, or Firm*—Evenson, McKeown, Edwards & Lenahan, P.L.L.C.

[57] ABSTRACT

The invention relates to a method for adjusting the drive performance of a motor vehicle having an internal combustion engine with spark ignition. A set torque is determined on the basis of a desired torque which is input by the driver, and possibly additional desired torque requirements. The desired torque is achieved by influencing the load and/or the ignition angle. For this purpose, the invention distinguishes between three operating states. In a first operating state, the torque is adjusted with optimum efficiency by load regulation; in a second operating state the torque adjustment is made as rapidly as possible by an additional ignition angle adjustment. Finally, in the third operating state the torque specification for load regulation is established and the remaining torque adjustment is made by an additional ignition angle adjustment.

5 Claims, 2 Drawing Sheets

METHOD FOR ADJUSTING THE OPERATING ENERGY INPUT OF A MOTOR

BACKGROUND AND SUMMARY OF THE INVENTION

This application claims the priority of German patent document 198 07 126.4, filed Feb. 20, 1999, the disclosure of which is expressly incorporated by reference herein.

The invention relates to a method for controlling the drive performance of a motor vehicle having an internal combustion engine with spark ignition.

German patent document DE 44 07 475 A1 discloses such a method, in which the ignition angle, the air/fuel ratio and the load are influenced based on a setpoint for the torque to be delivered by the drive unit.

The goal of the present invention is to provide an improved method for adjusting the drive performance of a motor vehicle with an internal combustion engine with spark ignition, such that a centrally specified desired torque can be achieved simply and reliably for different dynamic requirements.

This and other objects and advantages are achieved by the control method according to the invention, in which three operating state are identified and output torque is controlled according to a different criterion for each. In a first operating state, the torque is adjusted with optimum efficiency by load regulation; in a second operating state the torque adjustment is made as rapidly as possible by an additional ignition angle adjustment. Finally, in the third operating state the torque specification for load regulation is established and the remaining torque adjustment is made by an additional ignition angle adjustment.

In engine control, the coordination of the various demands on the vehicle drive is decoupled by the method according to the invention from the functions that adjust the internal combustion engine. The torque interface merely provides a desired torque and information on the dynamics with which this torque requirement is to be adapted to control the engine. It is immaterial in this regard how many partial systems are involved in the torque interface and how the current coordination is performed. By creating three operating states in which the requirements are met with different dynamics and with different goals, the various requirements of all the partial systems can still be taken into account.

By creating a transitional operating state with an associated threshold value for an ignition angle correction factor, it is possible to prevent abrupt retardation of a major ignition angle adjustment (and hence a perceptible change in torque), such as could result from a direct transition from an operating state with ignition angle adjustment, to an operating state without ignition angle adjustment.

Other objects, advantages and novel features of the present invention will become apparent from the following detailed description of the invention when considered in conjunction with the accompanying drawings.

DETAILED DESCRIPTION OF THE DRAWINGS

Figure 1:
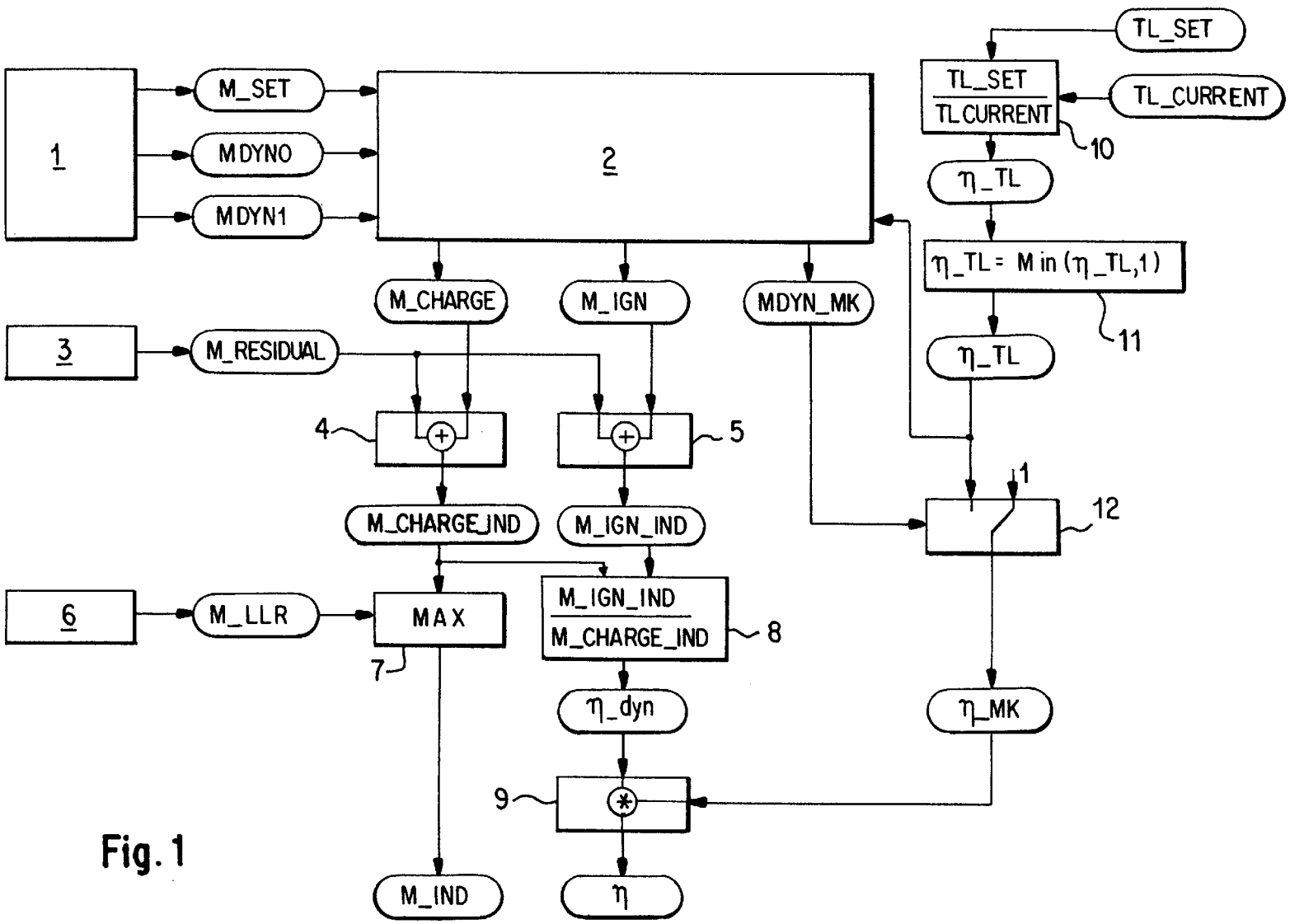
FIG. 1 is a structural diagram of an embodiment of the method according to the invention.

The starting point for the method described in the drawing is a desired setpoint $M_{set}$. In order to determine a desired set torque value $M_{set}$, a driver's desired torque (determined from a specification made by the driver in advance) and possibly additional desired torques $M_i$, are taken into consideration to produce a resultant desired torque $M_{set}$. This process preferably involves a so-called torque interface (block 1 in FIG. 1) in which the torque desired by the driver is processed with other desired torques $M_i$ (such as may be received, for example, from a transmission control, from a driving dynamics regulation, or other partial systems of the drive regulation) to produce a resultant desired torque $M_{set}$. A torque interface of this kind is known from the prior art, and will therefore not be described in greater detail here.

In addition, information on the dynamics with which the torque adjustment is to take place is provided in the form of two so-called dynamic bits MDYN0 and MDYN1 by the torque interface in block 1. In four-cycle engines, torque requirements can be conveyed in known fashion via the air path and/or an ignition intervention. The particular types of torque adjustment desired are defined by the two dynamic bits MDYN0 and MDYN1 as operating states Z1 to Z3:

TABLE 1

| Torque adjustment | MDYN1 | MDYN0 | State |
|---|---|---|---|
| Efficiency-optimum torque adjustment via the air path | 0 | 0 | Z1 |
| Fastest possible torque adjustment by ignition angle adjustment and air path | 0 | 1 | Z2 |
| Momentary setpoint for the air path is frozen, torque reduction takes place by ignition angle adjustment | 1 | 0 | Z3 |
| Invalid combination | 1 | 1 | — |

If the desired torque $M_{set}$ for example is to result from an efficiency-optimum torque adjustment, in other words the operating state Z1 prevails, the following dynamic bits are transmitted from block 1 to block 2:

MDYN0:=0 MDYN1:=0

If the desired torques $M_i$ of several partial systems are coordinated at torque interface 1, the various dynamic requirements of the partial systems must also be coordinated there. During normal operation of headway-regulating cruise control, for example, an efficiency-optimum torque adjustment is specified. Under certain operating conditions, however, the headway-regulating cruise control can also be switched to the fastest possible desired torque adjustment. In driving dynamics regulating systems, on the other hand, a desired torque adjustment that is as rapid as possible is specified for normal operation, while under certain operating conditions, a switch can be made to a torque adjustment with a lead. Transmission control also usually dictates a torque adjustment that is as rapid as possible.

Of course, the foregoing are only examples. The processing of the individual torque specifications $M_i$, and the corresponding dynamic requirements to produce a desired torque $M_{set}$ and a dynamic requirement MDYN0, MDYN1 is not the subject of this patent application and will therefore not be described further. The subject of this application is a method by which a specified desired torque $M_{set}$ can be effectively adjusted under different dynamic requirements.

In block 2, the desired torque $M_{set}$ is then divided as a function of the current operating state Z1 to Z3 into a charging torque $M_{charge}$ and a resultant torque $M_{ign}$. The charging torque $M_{charge}$ is adjusted by load regulation while the resultant torque $M_{ign}$ is also controlled by an ignition angle adjustment. In addition, in block 2 another control bit $MDYN_{MK}$ whose function will be described in greater detail below is provided in accordance with the following table:

TABLE 2

| Operating state | $M_{charge}$ | $M_{ign}$ | $MDYN_{MK}$ |
|---|---|---|---|
| Z1 | : = $M_{set}$ | $M_{set}$ | 0 |
| Z2 | : = $M_{set}$ | $M_{set}$ | 1 |
| Z3 | : = Max ($M_{charge}$ (k−1), $M_{set}$) | $M_{set}$ | 1 |
| Z4 | : = $M_{set}$ | $M_{set}$ | 1 |

In operating state Z4, a transitional state is involved that will be explained in greater detail below with reference to FIG. 2. In operating state Z3, the charging torque $M_{charge}$ is established. This means that upon entry into operating state Z3 the charging torque $M_{charge}$ is set to the current desired torque $M_{set}$. Thereafter with each determination, the current desired torque $M_{set}$ is compared with the charging torque $M_{charge}$(k−1) of the last cycle and the larger of the two values is stored and reproduced as the current charging torque $M_{charge}$. This means that in operating state Z3 the charging torque $M_{charge}$ cannot be reduced, rather it can only increase.

In block 3 a residual torque $M_{residual}$ is determined that is composed of the frictional torque and the torque required for driving auxiliary components. The frictional torque can be determined from the current engine rpm, oil temperature, and possibly other operating parameters. This residual torque $M_{residual}$ is added in blocks 4 and 5 to determine the indexed charging torque $M_{charge\text{-}ind}$ and the indexed resultant torque $M_{ign\text{-}ind}$ to form the effective charging torque $M_{charge}$ or the effective resultant torque $M_{ign}$.

In addition, in block 6 an idle torque $M_{idle}$ is determined for idle regulation and compared in block 7 with the indexed charging torque $M_{charge\text{-}ind}$, with the larger of the two values being transmitted to the load regulation as the indexed torque $M_{ind}$. The manner of load regulation is known per se, and therefore will not be described at length here. In such load regulation, on the basis of the current engine rpm and possibly additional operating parameters, a load setpoint $TL_{set}$ is determined from the indexed torque $M_{ind}$. At the same time, the current load value $TL_{current}$ is determined, for example with the aid of an air mass meter, and continually compared with the load setpoint $TL_{set}$, and a differential value is calculated. This differential value is then regulated to zero if possible by controlling the throttle flap.

In block 8, a first ignition angle correction factor $\eta_{dyn}$ is determined from the quotient of the indexed resultant torque $M_{ign\text{-}ind}$ and the indexed charging torque $M_{charge\text{-}ind}$, and in block 9 it is multiplied by a second ignition angle correction factor $\eta_{MK}$ to calculate the resultant ignition angle correction factor $\eta$. Then, with the aid of a characteristic diagram, a retard angle for the ignition angle calculation can be determined from the resultant ignition angle correction factor $\eta$.

The second ignition angle correction factor $\eta_{MK}$ is calculated starting in block 10. There, a correction factor $\eta_{TL}$ is calculated from the quotient of the load setpoint $TL_{set}$ and the current load value $TL_{current}$, and is limited to the maximum value of 1 in block 11 by a MIN comparison. This limited correction factor $\eta_{TL}$ is passed on to both block 2 and block 12. In block 12, as a function of control bit $MDYN_{MK}$ which is transmitted from block 2 to block 12 and on the basis of the limited correction factor $\eta_{TL}$, the second ignition angle correction factor $\eta_{MK}$ is determined. The second ignition angle correction factor $\eta_{MK}=1$ if the control bit $MDYN_{MK}=0$; otherwise, $\eta_{MK}=\eta_{TL}$ if the control bit $MDYN_{MK}=1$. As already described above, the second ignition angle correction factor $\eta_{MK}$ in block 9 is multiplied by the first ignition angle correction factor $\eta_{dyn}$ to calculate the resultant ignition angle correction factor $\eta$.

As can be seen from Table 2, in the first operating state Z1 both the charging torque $M_{charge}$ and the resultant torque $M_{ign}$ are equated to $M_{set}$. In this way, during the formation of a quotient in block 8, a first ignition angle correction factor $\eta_{dyn}=1$ is obtained. Since the control bit $MDYN_{MK}=0$ the second ignition angle correction factor $\eta_{MK}$ in block 12 is likewise set to the value of 1. This produces a resultant ignition angle correction factor $\eta=1$; in other words the ignition angle is not corrected. Thus, by virtue of the load regulation, the entire torque adjustment efficiency becomes optimum over the charging torque $M_{charge}=M_{set}$.

In the second operating state Z2, as in the first operating state Z1, both the charging torque $M_{charge}$ and the resultant torque $M_{charge}$are equated to $M_{set}$. Thus, in the quotient formation in block 8, a first ignition angle correction factor $\eta_{dyn}=1$ is obtained. In contrast to the operating state Z1 however, the control bit $MDYN_{MK}=1$. (See Table 2.) Thus, in block 12 the limited correction factor $\eta_{TL}$ from block 11 is transmitted as the second ignition angle correction factor $\eta_{MK}$ to block 9. The correction factor $\eta_{TL}$ is calculated, as described above, in block 10 by quotient formation from the load setpoint $TL_{set}$ and the current load value $TL_{Current}$. If the load setpoint is greater than the current load value $TL_{set}>TL_{current}$, a correction factor $\eta_{TL}>1$ is obtained. This is then limited to the value $\eta_{TL}=1$ in block 11. As a result, it is taken into account that the current load value is reduced by an ignition retardation, but cannot be increased. On the other hand, if the load setpoint in block 10 is less than the current load value $TL_{set}<TL_{current}$, a correction factor $\eta_{TL}<1$ is obtained. This is then transmitted as the second ignition angle correction factor $\eta_{MK}$ to block 9 and, following multiplication with the first ignition angle correction factor $\eta_{dyn}=1$, is transferred as the resultant ignition angle correction factor $\eta$ to the ignition angle calculation. In this case therefore, in addition to load regulation, a torque reduction that is as rapid as possible is implemented by ignition retardation.

In the third operating state Z3, torque adjustment is performed with a lead. This means that with a reduction of the set torque $M_{set}$ the charging torque $M_{charge}$ is set to the original value $M_{charge}$(k−1). The torque reduction in this case takes place exclusively by ignition timing adjustment. With an increase in the set torque $M_{set}$, however, the charging torque $M_{charge}$ is increased accordingly and thus the load regulation is performed accordingly. Determination of the second ignition angle correction factor $\eta_{MK}$ takes place in a manner similar to that of operating state Z2. In addition, however, in block 8 the resultant torque $M_{ign}$ can be distinguished from the charging torque $M_{charge}$ so that a first ignition angle correction factor $\eta_{dyn}$ that differs from 1 is obtained. Since the resultant torque $M_{ign}=M_{set}$ and the charging torque can only assume values $M_{charge}\geqq M_{set}$, a first ignition angle correction factor of $\eta_{dyn}\leqq 1$ is obtained. In this operating state Z3, both ignition angle correction factors $\eta_{dyn}$, $\eta_{MK}$ can contribute to the ignition angle adjustment.

Figure 2:
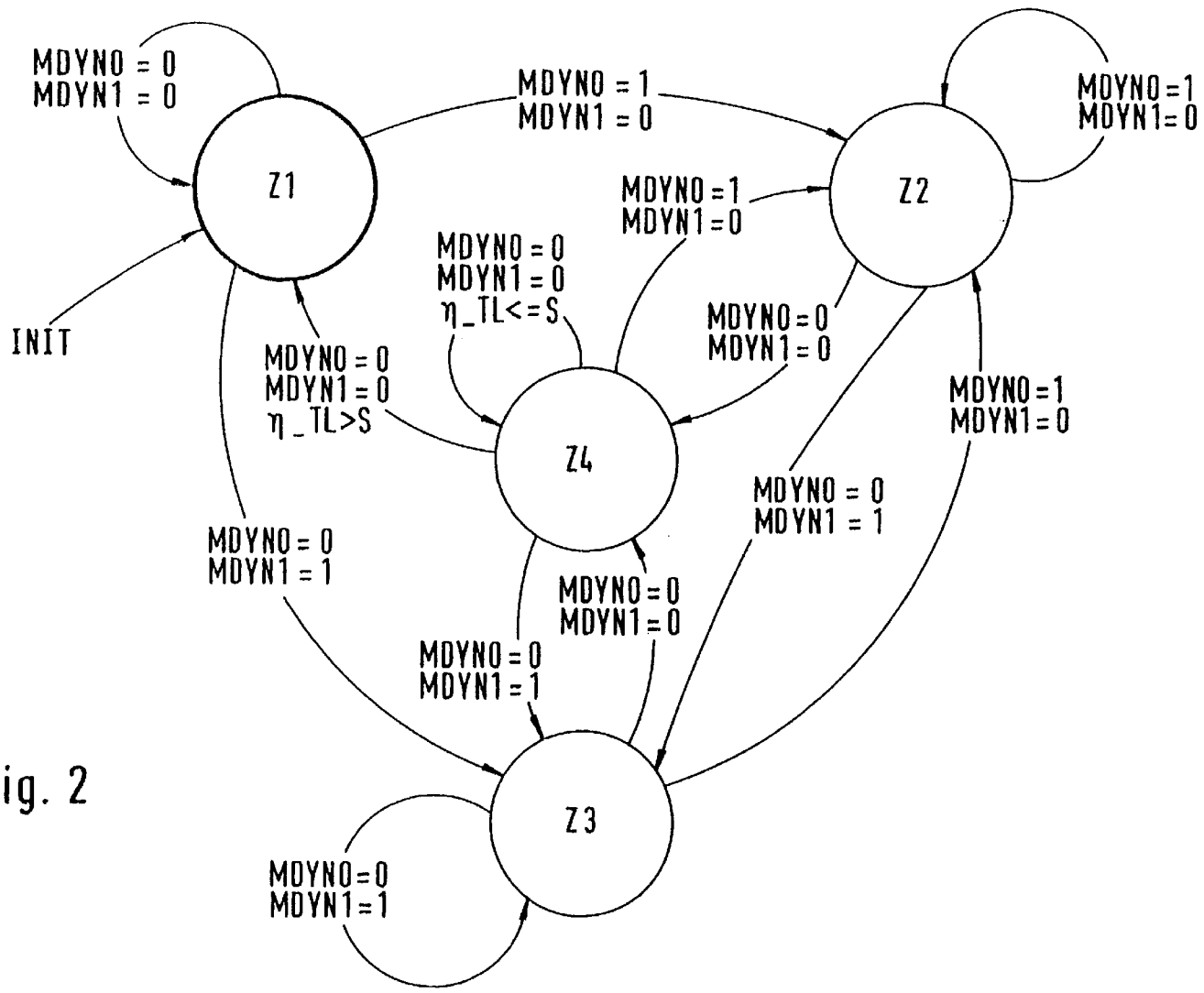
FIG. 2 is a schematic diagram of the possible transitions between the individual operating states.

Finally, it should now be explained briefly with reference to FIG. 2 how the transition between the individual operating states Z1 to Z4 takes place. In addition to the operating states Z1 to Z3 already described above, in this case an additional transitional operating state Z4 is provided whose function is described in the following. The method for determining the indexed torque $M_{ind}$ and the resultant ignition angle correction factor $\eta$ corresponds completely to the method in operating state Z2.

Referring to FIG. 2, upon starting, the operating state Z1 is selected by way of an initialization. Depending on the currently determined dynamic requirement MDYN0, MDYN1 in block 1, a new operating state Zi is then selected. The possible transitions between the operating states Zi are indicated in FIG. 2 as arrows with corresponding conditions. As can be seen, starting at operating state Z1, only one transition to either operating state Z2 or Z3 is possible. (A direct transition from operating state Z1 to the transient operating state Z4 is not provided.) Moreover, any change between operating states Z2, Z3, and Z4 is possible, but no provision is made for a direct change from operating states Z2 or Z3 to operating state Z1. One can return to operating state Z1 only via the transitional operating state Z4, and only if, in addition, the limited correction factor $\eta_{TL}$ is greater than a specified threshold value s. This arrangement thus prevents an abrupt reduction of a large ignition angle adjustment (and hence a perceptible change in torque), such as a change that could result from a direct jump from operating state Z2 or Z3 to Z1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for adjusting the driving performance of a motor vehicle having an internal combustion engine with spark ignition, comprising:

determining a set torque value $M_{set}$ based on a desired torque input by driver of the vehicle, and possibly additional desired torque requirements; and adjusting engine torque to achieve the set torque value $M_{set}$ by influencing at least one of a load and an ignition angle of the engine; wherein, adjustment of engine torque is performed based on an operating state of said vehicle, determined from vehicle operating conditions;

in a first operating state torque adjustment is performed in an efficiency-optimal fashion by load regulation;

in a second operating state the torque adjustment is accomplished as rapidly as possible by an additional ignition angle adjustment; and in a third operating state torque specification for load regulation is established and residual torque adjustment is accomplished by an additional ignition angle adjustment.

2. Method according to claim 1, wherein:

the set torque value $M_{set}$ is divided as a function of a current operating state, into a charging torque and a resultant torque;

a load setpoint is determined from the charging torque and a switch is made to the load setpoint with the aid of a load regulation of the current load value;

a first ignition angle correction factor is determined from a quotient of the resultant torque and the charging torque;

a second ignition angle correction factor is determined from a quotient of the load setpoint and the current load value;

in a first operating state the second ignition angle correction factor is made equal to 1;

a resultant ignition angle correction factor is determined from a product of the first and second ignition angle correction factors; and from the resultant angle ignition factor, a retardation angle is determined for the ignition angle calculation.

3. Method according to claim 2, wherein the second ignition angle correction factor is less than or equal to 1.

4. Method according to claim 2, wherein the charging torque is limited larger than or equal to an idle torque.

5. Method according to claim 2, wherein a transition from the second operating state or the third operating state to the first state is possible only if the second ignition angle correction factor exceeds a specified threshold value (s).

* * * * *